US005462070A

United States Patent [19]

Rahardja

[11] Patent Number: 5,462,070

[45] Date of Patent: Oct. 31, 1995

[54] METHOD AND APPARATUS FOR MAKING A FILTER CIGAR PRODUCT

[75] Inventor: Budianto Rahardja, Kudus, Indonesia

[73] Assignee: P.T. Djarum, Bagian Produksi Cerutu, Per Wakilan, Indonesia

[21] Appl. No.: 181,910

[22] Filed: Jan. 18, 1994

[51] Int. Cl.[6] ..... A24C 1/00

[52] U.S. Cl. ..... 131/76; 131/94

[58] Field of Search ..... 131/29, 32, 47, 131/61.1, 76, 58, 88, 94

[56] References Cited

U.S. PATENT DOCUMENTS

| | | | |
|---|---|---|---|
| Re. 30,865 | 2/1982 | Marritt et al. . | |
| 1,957,958 | 5/1934 | Hauser et al. | 131/361 |
| 2,104,329 | 1/1938 | Levy | 131/361 |
| 2,988,402 | 6/1961 | Policansky | 131/94 X |
| 3,165,106 | 1/1965 | Schon | 131/29 X |
| 3,276,454 | 10/1966 | Schon . | |
| 4,243,053 | 1/1981 | Cartwright et al. . | |
| 4,256,124 | 3/1981 | Higgins et al. . | |
| 4,267,848 | 5/1981 | Rijckaert . | |
| 4,295,479 | 10/1981 | Boogers . | |
| 4,505,281 | 3/1985 | Boogers . | |

FOREIGN PATENT DOCUMENTS

| | | | |
|---|---|---|---|
| 1229423 | 9/1960 | France . | |
| 271919 | 2/1951 | Switzerland . | |
| 867953 | 5/1961 | United Kingdom | 131/29 |

*Primary Examiner*—Jennifer Bahr

[57] ABSTRACT

A method and apparatus are described for forming a cigar type product having a filter disposed therein. The filter is positioned inwardly of the ends of the cigar such that the smoke may pass through the filter and subsequently through the additional tobacco filler. A band is provided on the overwrap of the cigar to indicate the location of the filter. This has the advantage of preventing inadvertent smoking of the filter by the smoker. The apparatus is arranged such that the filter may be selectively positioned within the filler of the cigar type product.

5 Claims, 4 Drawing Sheets

METHOD AND APPARATUS FOR MAKING A FILTER CIGAR PRODUCT

FIELD OF THE INVENTION

The present invention relates to a filter cigar type product and more particularly, the invention relates to a method and apparatus for manufacturing a filter cigar type product.

BACKGROUND OF THE INVENTION

Generally speaking, filter tobacco products have been proposed in the art for many years. In particular, cigar type products have been proposed which include a filter therein much like a cigarette product. One reference which relates to a cigar having a filter therein is Swiss Patent No. 271,919. This reference clearly provides a cigar product within which is disposed a filter medium for filtering the smoke. The filter is disposed between the ends of the cigar and more particularly, such that the filter has tobacco on both sides thereof. Although this is a convenient arrangement, the Swiss reference does not provide any indication to the smoker when he or she reaches the filter material. As a result, the smoker often encounters a filter and smokes the same.

In a similar situation, French Patent No. 1,229,423 discloses a cigar product having a filter therein. Similar to the Swiss reference discussed hereinabove, the French patent does not address the problem of indicating to the smoker when the filter is reached.

U.S. Pat. No. 4,243,053 provides an improved filter tip cigar wherein the patentees have positioned a filter at the extreme end of the cigar and surrounded the same with coated paper, etc. which is not susceptible to disintegration by saliva or by mastication. In addition, the patentees have provided a non-flammable material for positioning about the filter to thus prevent a smoker from smoking the filter disposed therein. This reference does not provide tobacco filler on both sides of the filter and accordingly is limited in this extent.

Further, U.S. Pat. No. 4,256,124, provides a method and apparatus for manufacturing a cigar such as that illustrated in U.S. Pat. No. 4,243,053. In the apparatus disclosed by the patentees, there is clearly provided dispensing means for dispensing the filter at one end of the cigar. This reference, since the final product does not provide a filtered cigar product wherein the filter is spaced inwardly from the end of the cigar, does not teach a filter positioning apparatus for selectively positioning the filter between the ends of the cigar and more particularly, inwardly of one extreme end of the cigar.

In further prior art, C. E. Schon, in U.S. Pat. No. 3,276,454, teaches a cigar machine for forming a cigar with a filter therein. This apparatus is primarily directed to the incorporation of a filter at one outside end of the cigar product. As such, the patentee does not provide a filter positioning means which is suited for selective positioning of the filter inwardly of one extreme end of the cigar.

As a result of the disadvantages of the prior art apparatus, and particularly for good quality cigars, where it has been desired to include a filter, normally they have been hand-rolled. As will appreciated, such hand-rolled cigars which include filters will necessarily represent a high degree of labour content.

The positioning of the filter in an interiorly spaced relationship from one end of the cigar product has a distinct advantage in that the filter does not derogate the flavour of the tobacco. More particularly, since the filter smoke stream can subsequently pass through additional tobacco material, the flavour is richer and fuller as compared to a cigar having the filter at the extreme end, the latter which results in the smoker experiencing only filtered smoke. In addition to the foregoing, another attractive feature of an inwardly spaced filtered cigar is the aesthetic appeal of the same. Due to the positioning of the filter within the cigar filler material, the filter is obscured from view thus giving the appearance of an unfiltered cigar.

Further still, it would be useful for a filtered cigar, such as that which is the subject of the present invention, to have a non-flammable, non-combustible band positioned about the overwrap of the cigar and more specifically to indicate the position of the filter, such that the smoker does not smoke the filter inadvertently.

In view of the areas of limitations in the cigar products and various apparatus for fabricating the same, there is required a method and apparatus for producing a filtered cigar, wherein the filter is spaced inwardly of one extreme end of the cigar product and further which may include a non-flammable, non-combustible band to demarcate the area the filter occupies on the cigar product.

SUMMARY OF THE INVENTION

One object of the present invention is to provide an improved cigar-making apparatus and process therefor. The present invention, according to a further object provides a method of producing a cigar type product having opposed ends and a filter therein, comprising the steps of: providing a supply of tobacco filler and wrapper material for forming a cigar; selectively positioning a filter between the ends; introducing the tobacco filler onto the wrapper material; and forming the cigar.

In an advantageous feature of the cigar product made in accordance with the method of the present invention same may include suitable conventional wrappers forming the cigar and being provided with, for example, a reinforced band about the filter area of the cigar so that it notifies a user that the filter is located in that area and that the cigar should not be smoked beyond a defined area.

According to a further object of the present invention is to provide a method of producing a cigar type product having opposed ends and a filter therein, comprising the steps of providing a supply of tobacco filler and a wrapper material for forming a cigar; placing said filter within at least a portion of the wrapper material while selectively positioning said filter between the ends of said wrapper material; introducing said tobacco filler onto said wrapper material; and wrapping said filler and said filter with said wrapper material to form said cigar.

In a particularly preferred feature, the band member secured about the cigar type product will preferably be non-combustible and non-flammable material which additionally may be capable of self-extinguishing. Suitable materials include those treated paper known to provide such features together with metallic inserts, e.g. foil, etc. The band is preferably adhered to the overwrap layer such that the same is not subject to movement during processing and/or shipping as this would detract from the benefit of indicating to the smoker the precise location of the filter. Suitable adhesives for effecting a good bond may include, for example, food grade polyvinylacetate emulsions or emulsion type adhesives, methyl cellulose based adhesives, gums such as gum tragacanth and mixtures of cellulose gums, carboxy methyl cellulose, synthetic gums and protein colloids. Any number of suitable, non-toxic, adhesives may be employed for this purpose and a host of such suitable adhesives will be readily by those skilled in the art.

Yet another object of the present invention is to provide an apparatus for producing a filter cigar type product comprising: a filter positioning means for selectively positioning a filter having opposed ends between the ends of the cigar type product; dispensing means for dispensing a charge of tobacco filler at both ends of the filter; and forming means for wrapping the tobacco filler and the filter disposed therein to form the cigar type product.

One of the particularly attractive features of the apparatus is that the same may be retrofitted onto an existing cigar manufacturing apparatus. In terms of the filter positioning means, the same may include a magazine having a grooved sprocket disposed at a dispensing end for precisely locating a filter within the tobacco filler charge. It is clearly contemplated that the magazine and sprocket arrangements be substituted by a conventional vacuum grooved wheel, which apparatus is known in the cigarette manufacturing industry but for different purposes.

In utilizing the apparatus of the present invention, the apparatus may include storage means such as a bin, chamber or the like for receiving a plurality of individual filters and means for dispensing the filters, one at a time, to the magazine with the grooved sprocket. In such an arrangement, such storage means may be fed by any suitable means for delivering a quantity of filters, in either a continuous or discontinuous manner. Thus, the apparatus of the present invention may operate in conjunction with a filter supply means.

A further advantage of the filter positioning means is that the same is slidable relative to a tobacco filler discharging member such that the manufacture may position the filter any distance from an extreme end of the cigar type product.

It will be clearly appreciated that the method and apparatus as set forth herein are clearly applicable to the manufacture of conventional cigars having a filter disposed therein in addition to variations thereof, e.g. cigarillos, etc. In particular, the apparatus of the present invention may be used as an "add-on" to known equipment. Typical of such equipment are devices such as Arenco cigar-making machines. Such known pieces of equipment can be readily modified without significant changes to the basic components thus rendering a known machine capable of producing an improved product according to the present invention.

Having thus generally described the invention, reference will be made to the accompanying drawings illustrating preferred embodiments.

DETAILED DESCRIPTION OF THE PREFERRED EMBODIMENTS

Figure 1:
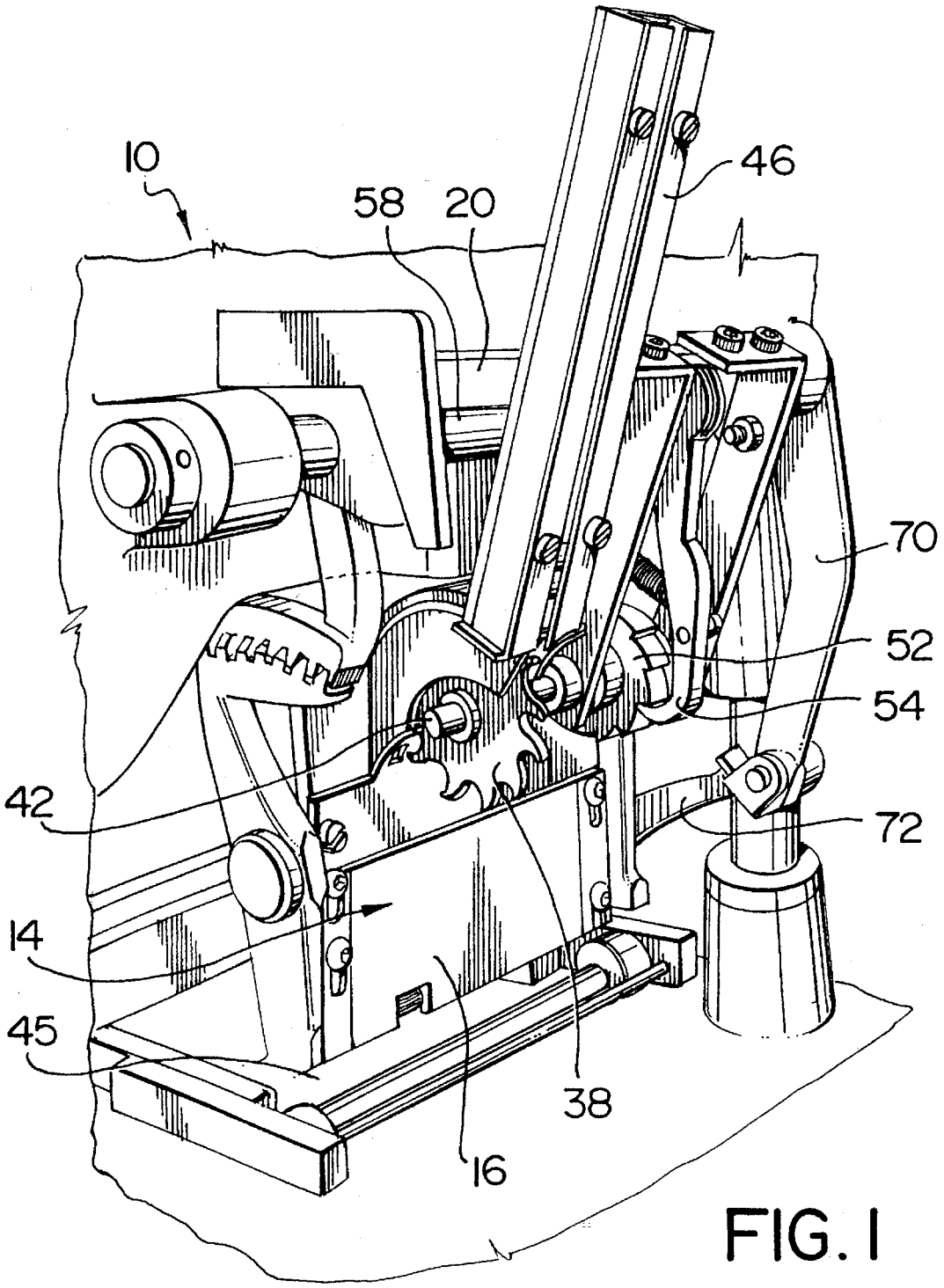
FIG. 1 is a perspective view of the apparatus according to one embodiment of the present invention.
Figure 2:
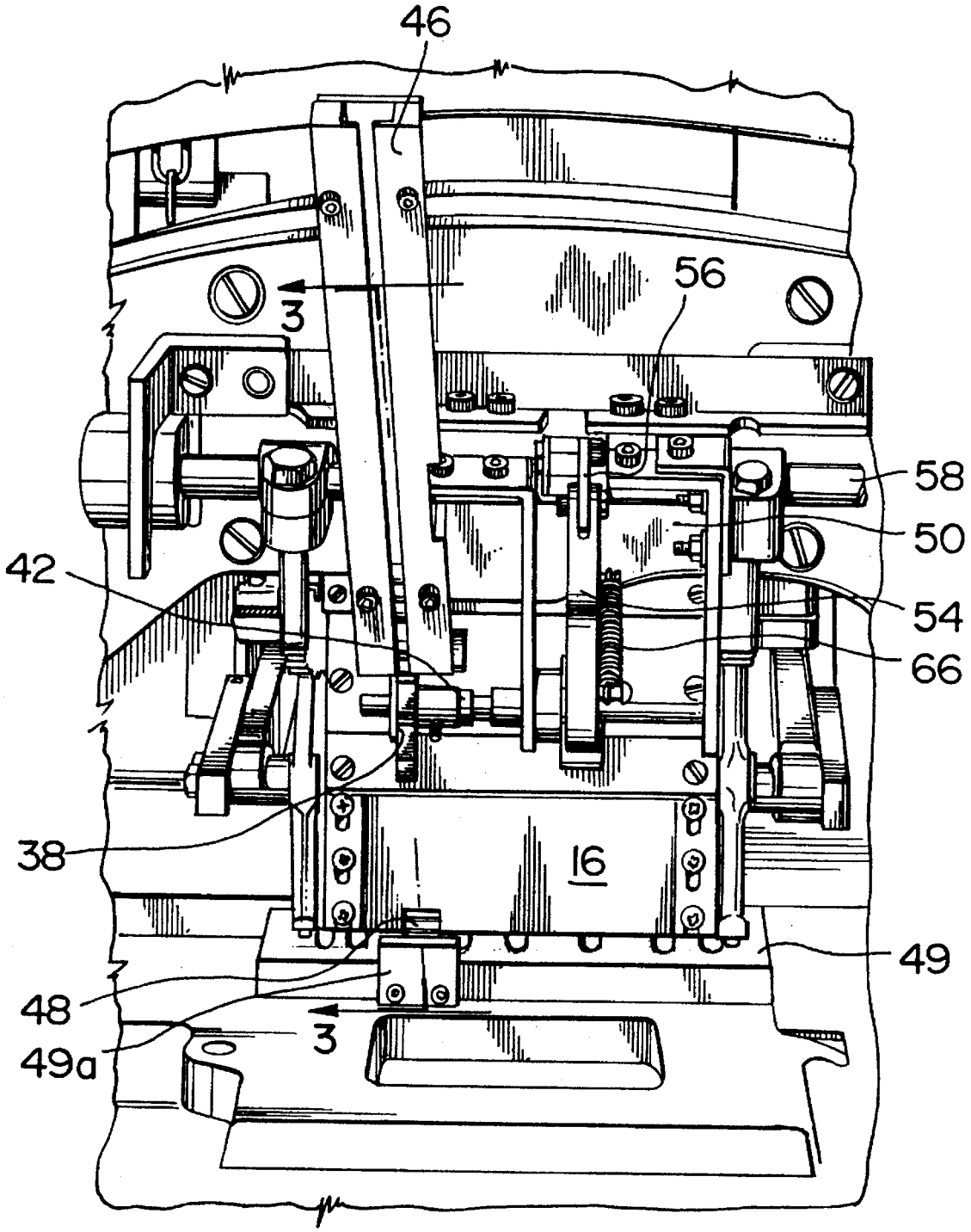
FIG. 2 is a front elevational view of the apparatus.

Referring now to FIG. 1, numeral 10 denotes an overall cigar manufacturing apparatus known in the art as an Arenco MIR01 Cigar Machine. As such, the known conventional parts except as necessarily for understanding the present invention are not described. FIG. 1 illustrates such a conventional machine together with the retrofit arrangement according to the present invention as mounted thereto. In brief overview, the conventional apparatus known for manufacturing the cigars includes a first mounting plate 12 to which is connected a tobacco filler magazine 14.

Figure 3:
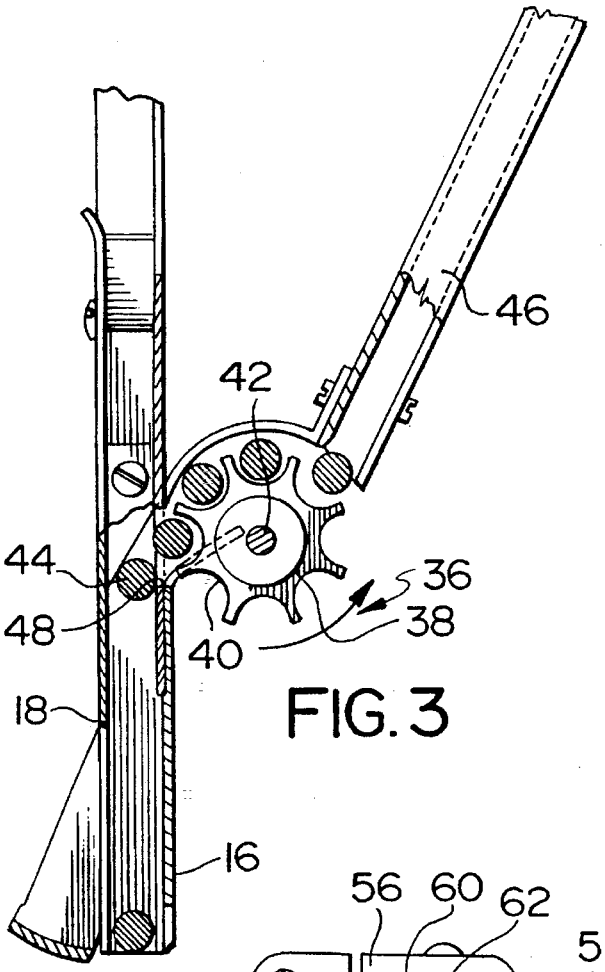
FIG. 3 is a section along line 3—3 of FIG. 2.
Figure 5:
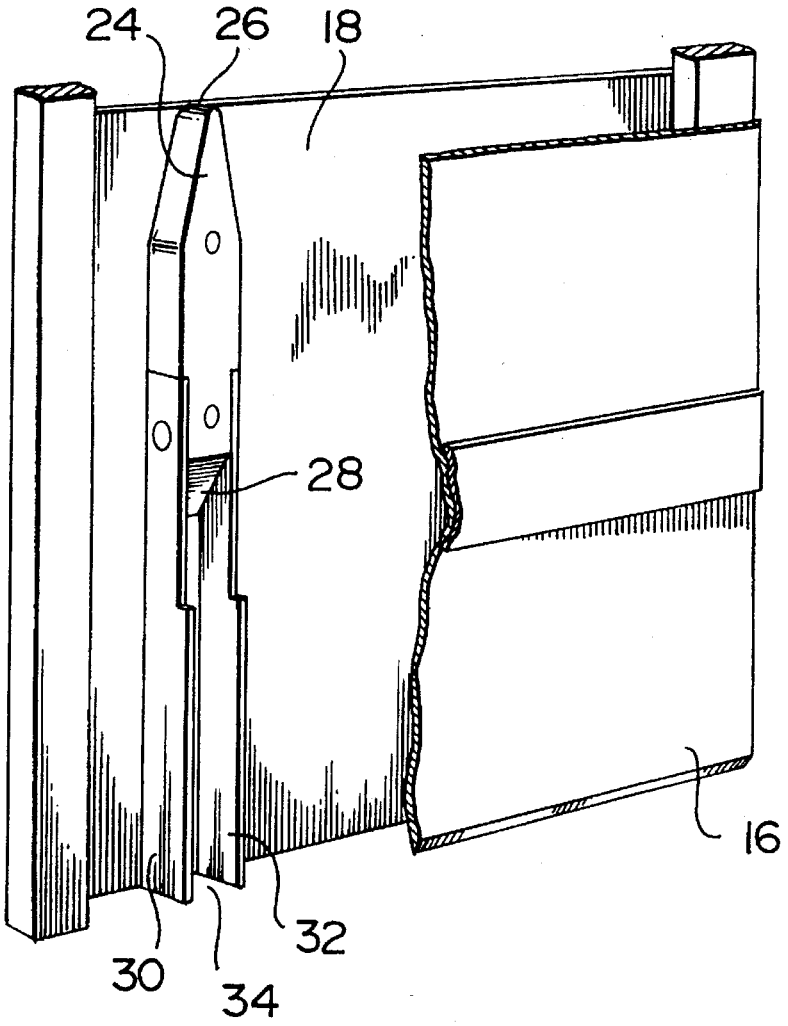
FIG. 5 is a cut-away view of the apparatus illustrated in FIG. 1, more clearly illustrated in the divider means.

Magazine 14 includes two connected spaced apart plates 16 and 18 illustrated best in FIGS. 3 and 5. The magazine 14 is open at a top and bottom portion.

Figure 6:
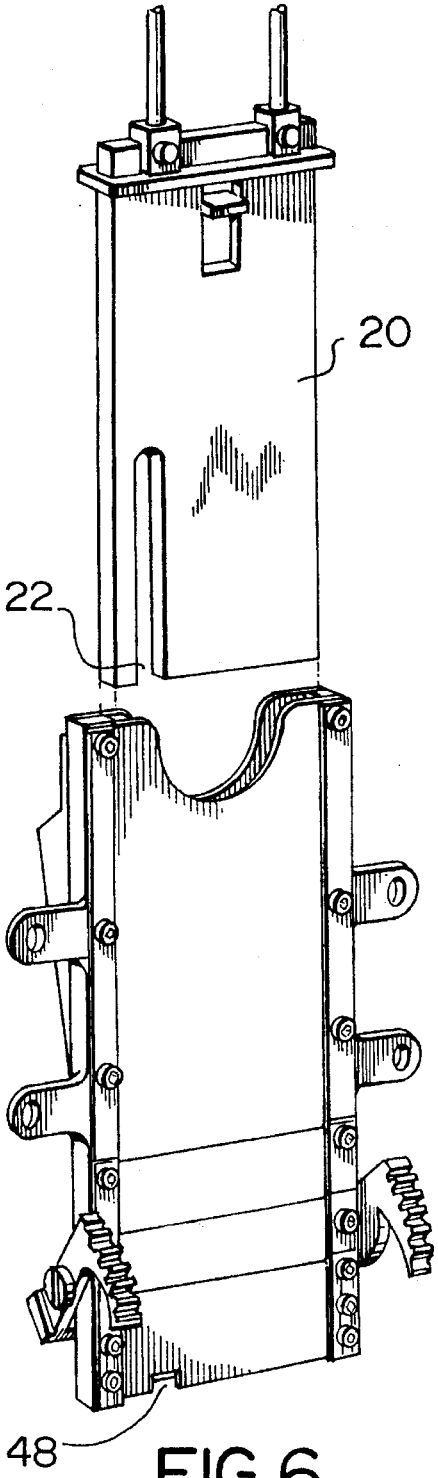
FIG. 6 is an exploded view of the mandrel and magazine.

Disposed for vertical movement within filler magazine 14 is a mandrel 20 for compressing tobacco filler material. Mandrel 20 is shown in FIG. 6. A slot 22 is provided extending inwardly from a lowermost edge thereof. The slot 22 is configured to accommodate a divider member 24 associated with plate 18 as illustrated in FIG. 5.

The divider member 24 includes pointed segment 26 and a tapering end portion 28. Each side of the divider member 24 includes a pair of spaced guides 30 and 32 defining a space therebetween and extending to the lowermost edge of plate 18.

The divider member 24 spreads tobacco, when the same is fed into magazine 14, to contact either side of guides 30 and 32. The area that is devoid of tobacco filler, generally denoted by numeral 34, is for receiving a filter by the filter positioning apparatus now described.

The filter positioning apparatus, denoted broadly by numeral 36 in FIG. 3, cooperates with the tobacco dividing member 24. The positioning apparatus 36 includes a grooved sprocket 38 having a plurality of grooves 40 thereon. Sprocket 38 is rotatably mounted on axle 42 and is positioned to receive a filter 44 from a supply magazine 46 containing a plurality of such filters 44. If desired, within the magazine 46, the filters may be oriented in an aligned row in order to facilitate their displacement into the grooved sprocket 38.

Figure 4:
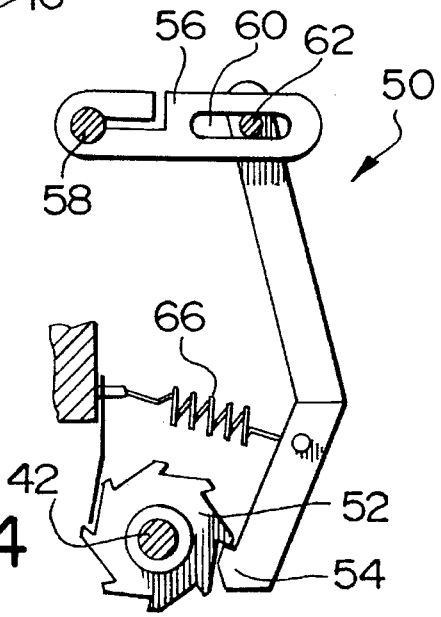
FIG. 4 is a sectional view of the actuating arrangement.

An opening 48 in wall 16 of magazine 14 permits a filter 44 to be disposed therethrough. The filter 44 is guided by the tapered segment 28 of dividing member 24 and located by guides 30 and 32. The filter 44 drops by gravity. Axle 42 extends horizontally across the apparatus for connection to an actuating arrangement 50 illustrated in side view in FIG. 4.

Figure 7:
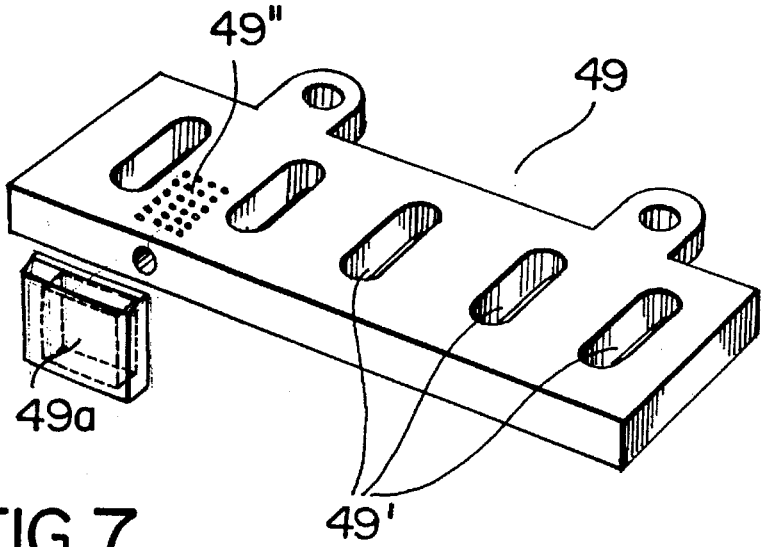
FIG. 7 is a perspective view of an embodiment of a suction plate for use in the apparatus.

In order to keep the filter 44 in a fixed position, beneath magazine 14 and clearly illustrated in FIG. 7, a holding member 49 for holding a filter 44 is included. The holding member 49, in the example, comprises a plate having a plurality of spaced apart suction openings 49.' The holding member 49 further includes a filter holding area having a plurality of small apertures 49" for holding a filter (not shown). The filter may be fixed therein against movement by suction. The plurality of openings 49' permit filter retention for a variety of locations in the tobacco product, i.e., at different locations between the ends of, for example, a cigar (not shown).

The actuating arrangement 50 assists in controlling the positioning of the filter 44 by controlling the rotation of sprocket 38. Axle 42 extends for connection with a ratchet wheel 52. Wheel 52 is releasably engageable with catch 54.

A linking member 56 connected to a main horizontal driver shaft 58 of the conventional apparatus. Linking member 56 includes a raceway 60, within which is disposed for movement therein, pin 62 associated with catch 54. As the main shaft 58 is moved, a commensurate movement is imparted to ratchet 52, thus rotating axle 42 and therefor sprocket 38.

Main shaft 58 is rotatably mounted, motion being transmitted thereto by cooperation of linkage 70 and linkage 72 as is known from the conventional apparatus.

A spring 66 extending between catch 54 and mounting plate 12, biases catch 54 into engagement with ratchet 52. Movement of the shaft 58 is achieved by an intermediate link 70, the latter being connected to a drive member 72.

Generally speaking, the overall process for manufacture machine-made filter cigars using the apparatus of the present invention together with the conventional Arenco apparatus, subscribes to the following steps: once the tobacco filler magazine of the Arenco machine is filled with filler tobacco and the filter magazine filled with the pre-cut filters in a horizontal, side-by-side position, the movement from the driver shaft of the original Arenco machine, discussed herein previously, will automatically place filler tobacco and a filter on a rolling table associated with the Arenco apparatus. This process places the filter in the pre-selected position between the filler tobacco.

Binder tobacco leaf (not shown) is spread on a leaf cutter of the apparatus, which then cuts the leaf according to a desired shape for the cigar. A suction arm (not shown) of the machine places the cut binder leaf onto the rolling table. The movement of the machine continues and the tobacco and filter are rolled diagonally into the binder leaf, thus producing the semi-finished cigar.

A wrapper tobacco leaf (not shown) is then spread on the leaf cutter and the wrapper leaf is cut according to a shape desired. The semi-finished cigar is automatically transferred to the next section where, with a movement similar to that set forth above, it is rolled diagonally into the wrapper leaf.

The final step is to trim the ends of the cigar according to the desired length and subsequently smoothing and forming one of the ends into a slightly cone-shaped mouthpiece.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A method of producing a cigar product having a cigar wrapping and having opposed ends and a filter therein, comprising the steps of:

providing a supply of cigar filters, tobacco filler and cigar wrapper material for forming a cigar product;

feeding a series of filters in sequence and placing each said filter within at least a portion of the cigar wrapper material;

selectively positioning said filter on said wrapper away from the ends of each said cigar wrapper and retaining said filter on said wrapper prior to the introduction of said tobacco filler;

dividing a charge of tobacco filler into two portions and introducing said tobacco filler portions onto said cigar wrapper material at both ends of said filter; and wrapping a formed cigar with overwrap material and adhering a band member about said overwrap to identify the position of said filter.

2. Apparatus for producing a filter cigar product having a cigar wrapper comprising:

a filter positioning means for selectively positioning a filter having opposed ends between the ends of a cigar wrapping;

an actuating member for actuating said filter positioning means, said actuating member including ratchet means, said ratchet means being connected to said filter positioning means;

dispensing means for dispensing a charge of tobacco filler at both ends of said filter; and forming means for wrapping said tobacco filler and said filter disposed immediate therein with said cigar wrapping to form said cigar product having the filter displaced from the ends of said product.

3. The apparatus as set forth in claim 2 wherein said apparatus includes a filter magazine for retaining a supply of filters and means to deliver filters in sequence.

4. The apparatus as set forth in claim 2 wherein said filter positioning means includes a grooved rotatable member for feeding and positioning said filter.

5. The apparatus as set forth in claim 4, wherein said grooved member feeds said filters between guides defining a vertical channel to cigar assembly means.

* * * * *

UNITED STATES PATENT AND TRADEMARK OFFICE

CERTIFICATE OF CORRECTION

PATENT NO. : 5,462,070

DATED : October 31, 1995

INVENTOR(S) : Budianto RAHARDJA

It is certified that error appears in the above-indentified patent and that said Letters Patent is hereby corrected as shown below:

On the cover page, the Assignee should read --P.T. Djarum, Bagian Produksi Cerutu, Per Wakilan--.

Signed and Sealed this

Sixteenth Day of January, 1996

*Attest:*

*Attesting Officer*

BRUCE LEHMAN

*Commissioner of Patents and Trademarks*